US008016059B2

(12) United States Patent
Gatell

(10) Patent No.: US 8,016,059 B2
(45) Date of Patent: Sep. 13, 2011

(54) GAGE INSERT

(75) Inventor: Joshua Gatell, Cypress, TX (US)

(73) Assignee: Smith International, Inc., Houston, TX (US)

( * ) Notice: Subject to any disclaimer, the term of this patent is extended or adjusted under 35 U.S.C. 154(b) by 166 days.

(21) Appl. No.: 12/028,359

(22) Filed: Feb. 8, 2008

(65) Prior Publication Data

US 2008/0190666 A1 Aug. 14, 2008

Related U.S. Application Data

(60) Provisional application No. 60/889,052, filed on Feb. 9, 2007.

(51) Int. Cl.
*E21B 10/50* (2006.01)

(52) U.S. Cl. ..... 175/431; 175/428; 175/57

(58) Field of Classification Search ..... 175/378, 175/399, 430, 431, 57, 426, 428
See application file for complete search history.

(56) References Cited

U.S. PATENT DOCUMENTS

| | | | | | |
|---|---|---|---|---|---|
| 4,058,177 | A | * | 11/1977 | Langford et al. | 175/374 |
| 4,086,973 | A | * | 5/1978 | Keller et al. | 175/374 |
| 4,108,260 | A | * | 8/1978 | Bozarth | 175/374 |
| 4,334,586 | A | * | 6/1982 | Schumacher | 175/374 |
| 4,722,405 | A | * | 2/1988 | Langford, Jr. | 175/374 |
| 4,832,139 | A | * | 5/1989 | Minikus et al. | 175/374 |
| 5,152,194 | A | | 10/1992 | Keshavan et al. | |
| 5,172,777 | A | * | 12/1992 | Siracki et al. | 175/374 |
| 5,351,769 | A | | 10/1994 | Scott et al. | |
| 5,351,771 | A | | 10/1994 | Zahradnik | |
| 5,415,244 | A | * | 5/1995 | Portwood | 175/374 |
| 5,791,423 | A | | 8/1998 | Overstreet et al. | |
| 5,813,485 | A | * | 9/1998 | Portwood | 175/430 |
| 5,967,245 | A | * | 10/1999 | Garcia et al. | 175/374 |
| 6,029,759 | A | | 2/2000 | Sue et al. | |
| 6,161,634 | A | * | 12/2000 | Minikus et al. | 175/331 |
| 6,460,636 | B1 | * | 10/2002 | Yong et al. | 175/428 |
| 6,997,273 | B2 | * | 2/2006 | Singh | 175/430 |
| 7,013,999 | B2 | * | 3/2006 | Tufts | 175/430 |
| 7,086,488 | B2 | * | 8/2006 | Richman | 175/374 |
| 7,100,711 | B2 | * | 9/2006 | Witman et al. | 175/331 |
| 2005/0023043 | A1 | * | 2/2005 | Tufts | 175/374 |
| 2005/0269139 | A1 | * | 12/2005 | Shen et al. | 175/430 |
| 2007/0084640 | A1 | * | 4/2007 | Singh | 175/331 |

OTHER PUBLICATIONS

Merriam-Webster Dictionary definitions of "prow," "wedge," and "pear-shaped", accessed at m-w.com on Jan. 8, 2010.*

* cited by examiner

*Primary Examiner* — Daniel P Stephenson
*Assistant Examiner* — Blake Michener

(57) ABSTRACT

A hard formation drill bit that includes a plurality of gage cutting elements disposed on the at least one roller cone, wherein at least one of the plurality of gage cutting elements includes a cutting portion. The cutting portion includes a partially spherical leading edge and an obtuse relieved trailing edge, wherein a volume of the partially spherical leading edge is greater than a volume of the obtuse relieved tailing edge. Also, a method of drilling a formation that includes such a drill bit. Also included is an insert and a method of manufacturing a gage cutting element.

28 Claims, 4 Drawing Sheets

GAGE INSERT

CROSS-REFERENCE TO RELATED APPLICATIONS

This application, pursuant to 35 U.S.C. §119(e), claims priority to U.S. Provisional Application Ser. No. 60/889,052, filed Feb. 9, 2007. That application is incorporated by reference in its entirety.

BACKGROUND

1. Field of the Disclosure

Embodiments of the present disclosure generally relate to drill bits for drilling earth formations. More specifically, embodiments of the present disclosure relate to the geometry of cuttings elements of roller cone drill bits. More specifically still, embodiments of the present disclosure relate to geometries of gage insert cuttings elements of roller cone drill bits.

2. Background Art

Traditionally, drilling systems used to drill earth formation include a drilling rig that is used to turn a drill string, which extends downward into a wellbore. Connected to the end of the drill string is a roller cone drill bit. Disposed on the drill bit are a plurality of cutting elements used to break away pieces of the formation during drilling.

In roller cone bits, the cutting elements drill the earth formation by a combination of compressive fracturing and shearing action. Prior art milled tooth bits typically have teeth formed from steel or other easily machinable high-strength material, to which a hardface overlay such as tungsten carbide or other wear resistant material is often applied. The hardfacing is applied by any one of a number of well known methods, There are a number of references which describe specialized exterior surface shapes for the substrate.

Specialized shapes are intended to provide a cutting structure which includes more thickness of hardface overlay in wear-prone areas, so that the useful life of the teeth may be increased. Examples of such specialized substrate shapes are shown in U.S. Pat. Nos. 5,791,423, 5,351,771, 5,351,769, and 5,152,194. These references show that the teeth have a substantially regular trapezoidal exterior hardface surface. The irregular shape of the substrate outer surface is selected to provide additional hardface in the wear prone areas while maintaining a conventional exterior tooth surface.

U.S. Pat. No. 6,029,759 issued to Sue shows a milled tooth drill bit having teeth in a gage row (i.e., the outermost row of teeth on any cone used to maintain full drilling diameter), wherein the teeth have a particular outer surface. The particular outer surface of these teeth is intended to make it easier to apply hardfacing in two layers, using two different materials. The purpose of such tooth structures is to have selected hardfacing materials positioned to correspond to the level of expected wear on the various positions about the outer surface of the tooth.

Polycrystalline diamond ("PCD") enhanced inserts and tungsten carbide ("WC-Co") inserts are two commonly used inserts for roller cone rock bits and hammer bits. A roller cone rock bit typically includes a bit body adapted to be coupled to a rotatable drilling string and include at least one cone that is rotatably mounted to the bit body. The cone typically has a plurality of inserts pressed into the surface. The inserts thus contact the formation during drilling.

The PCD layer on PCD enhanced inserts is extremely hard. As a results, the PCD layer has excellent wear resistance properties. While the actual hardness of the PCD layer varies for the inserts used in particular bit types, each type of PCD has a common failure mode of chipping and spalling due to cyclical impart loading on the inserts during drilling. Conversely, the softer, tougher tungsten carbide inserts tend to fail by excessive wear and not by chipping and spalling.

Examples of tungsten carbide inserts used on the gage row of roller cone bits include relieved gage chisel inserts and semi-round top inserts. Relieved gage chisel inserts are manufactured by increasing carbide on the leading side of the hole wall surface of the cutting element and increasing relief on the trailing side of the hole wall surface. Such relieved gage chisel inserts were designed for soft formation drill bits where the compressive forces are lower relative to harder formation. A second insert, the semi-round top insert is used in the gage row of hard formation drill bits. Because of the symmetric nature of the dome shaped cuttings portion of the insert, the insert may eventually break due to trailing side chipping after gage rounding, which may thereby result in additional insert breakage and/or drill bit failure.

When the gage row of a drill bit begins to fail due to, for example, chipped trailing edges of individual gage inserts, there is an increased likelihood of the entire drill bit failing. If a drill bit fails, the entire drill string must be removed from the wellbore, section-by-section, a process referred to as "tripping." Because the drill string may be miles long, tripping the drill string requires considerable time, effort, and expense. As such it is desirable to employ drill bits that are less prone to gage row failure that may ultimately result in a costly trip of the drill string.

Accordingly, there exists a need for hard formation cutting elements for roller cone drill bits that are more resistant to wear and chipping during drilling.

SUMMARY OF THE DISCLOSURE

In one aspect, embodiments disclosed herein relate to a hard formation drill bit that includes a bit body, and at least one roller cone attached to the bit body, and able to rotate with respect to the bit body. Furthermore, the drill bit includes a plurality of gage cutting elements disposed on the at least one roller cone, wherein at least one of the plurality of gage cutting elements includes a cutting portion. The cutting portion includes a partially spherical leading edge and an obtuse relieved trailing edge, wherein a volume of the partially spherical leading edge is greater than a volume of the obtuse relieved trailing edge.

In another aspect, embodiments disclosed herein relate to a hard formation insert that includes a grip portion and a gage cutting structure. The gage cutting structure includes a partially spherical leading edge and an obtuse relieved trailing edge, wherein a volume of the partially spherical leading edge is greater than a volume of the obtuse relieved trailing edge.

In another aspect, embodiments disclosed herein relate to a method of manufacturing a gage cutting element for hard formation drilling that includes designing the gage cutting element. The designing includes designing a gage cutting element that includes a cutting structure having a partially spherical leading edge and an obtuse relieved trailing edge, wherein a volume of the partially spherical leading edge is greater than a volume of the obtuse relieved trailing edge, and wherein the cutting structure is designed to wear during drilling to retain an obtuse included angle formed between the relieved trailing edge an a formation. The method further includes forming the insert.

In another aspect, embodiments disclosed herein relate to a method of drilling a formation that includes contacting a drill bit with the formation, wherein the drill bit includes a bit body. The drill bit further includes a plurality of gage cutting elements disposed on the bit body, wherein at least one of the plurality of gage cutting elements includes a cutting portion. The cutting portion includes a partially spherical leading edge and an obtuse relieved trailing edge, wherein a volume of the partially spherical leading edge is greater than a volume of the obtuse relieved trailing edge.

Other aspects and advantages of the disclosure will be apparent from the following description and the appended claims.

DETAILED DESCRIPTION

Generally, embodiments of the present disclosure relate to drill bits for drilling earth formations. In certain embodiments, the present disclosure relates to the geometry of cuttings elements of roller cone drill bits, and specifically, to geometries of gage insert cuttings elements of roller cone drill bits. As used herein, the term "cutting element" is used to generically refer to different types of inserts used on drill bits. Additionally, as used herein, the term "hard formation drill bit" refers to drill bits used in drilling hard and/or abrasive formations, such as, for examples, shale, sandstones, conglomerates, granite, calcites, mudstones, and cherty limestone. Those of ordinary skill in the art will appreciate that the above list of hard and/or abrasive formations is not exhaustive, and drill bits designed for use in other hard and abrasive formations may also benefit from the present disclosure.

Figure 1:
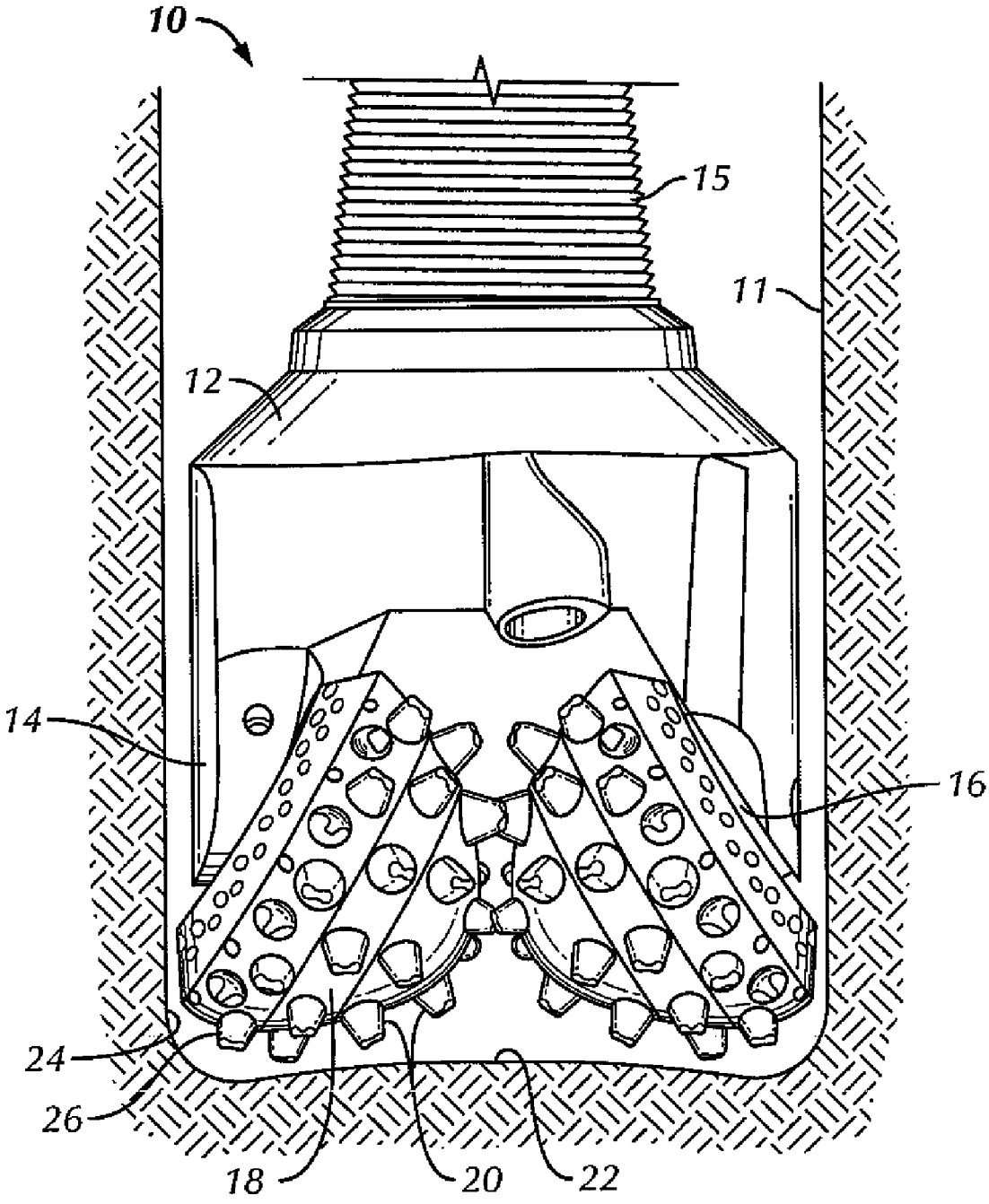
FIG. 1 shows a roller cone drill bit according to one embodiment of the present disclosure.

Referring to FIG. 1, a roller cone drill bit 10 according to one embodiment of the present disclosure is shown disposed in a wellbore 11. The bit 10 has a body 12 with legs 14 extending generally downward, and a thread pin end 15 opposite thereto for attachment to a drill string (not shown). Journal shafts 16 are cantilevered from legs 14. Rolling cutters, or roller cones 18, are rotatably mounted on the journal shafts 16. Each roller cone 18 has a plurality of inserts 20 mounted thereon.

As the body 12 is rotated by rotation of a drill string (not shown), the roller cones 18 rotate over the wellbore bottom 22 and maintain the gage of the wellbore 11 by rotating against a portion of the wellbore sidewall 24. As the roller cones 18 rotate, individual inserts are rotated into and then out of contact with the formation. As a result, the inserts undergo cyclical loading which may contribute to fatigue failure. Inserts 26 are called gage inserts because they contact, at least partially, the sidewall 24 to maintain the gage of the wellbore 11. All of the inserts, and particularly gage inserts 26, undergo repeated impact loading as they are rotated into and out of contact with the earth formation. According to the present disclosure, at least one gage insert 26 on the roller cone bit 10 has an improved cutting geometry, as described below.

In certain embodiments, inserts designed in accordance with the present disclosure may include a composite PCD material. For a roller cone bit application, the insert has a hardness of between about 1000 and 3000 measured on the Vickers hardness scale. This hardness provides a resulting increase in impact resistance that is beneficial for inserts used in roller cone drill bits, while not significantly sacrificing wear resistance. However, those of ordinary skill in the art will appreciate that inserts having hardnesses well outside this range may also be used, and as such, are within the scope of the present disclosure.

In other embodiments, inserts designed in accordance with the present invention may include tungsten carbide inserts. Those of ordinary skill in the art will appreciate that the type of insert material is not as significant as the improved geometries of the inserts, which are described below. Accordingly, it is expressly within the scope of the present disclosure that various compositions including, for example, boron nitride, tungsten carbide, and PCD, may be used with the below described geometries.

Figure 2A:
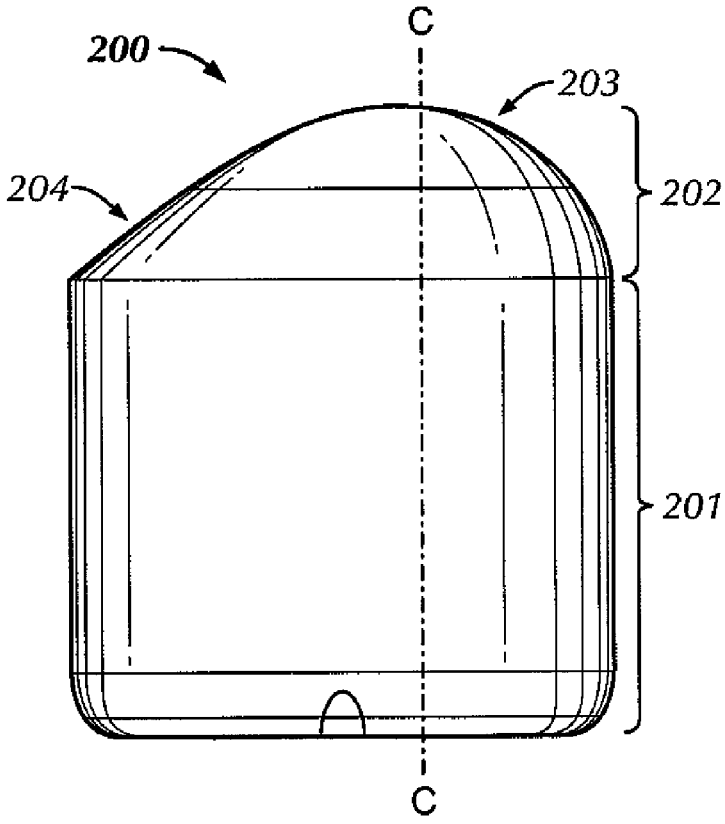
FIG. 2A shows a side view of an insert according to one embodiment of the present disclosure.
Figure 2B:
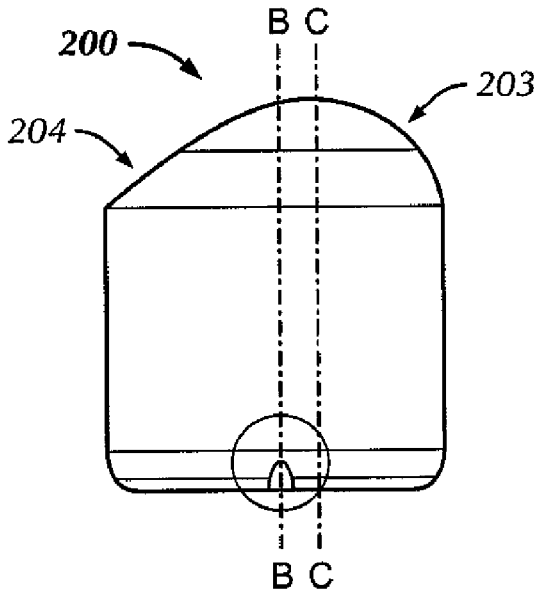
FIG. 2B shows a side view of an insert according to one embodiment of the present disclosure.

Referring to FIGS. 2A and 2B, one embodiment of an insert 200 according to the present disclosure is shown. Insert 200 may be used as any one of the inserts on a cone or a blade, but has particular application as a gage insert. According, the following description is made in reference to insert 200 being a gage insert. In this embodiment, insert 200 includes a grip portion 201 and a cutting portion 202. Grip portion 201 is sized for press fitting within sockets formed in the body of the roller cones of a drill bit. The cutting structure 202 may include an outer layer (not independently shown) that contacts formation, which is referred to as a contact surface (not independently numbered). In this embodiment, cutting structure 202 includes a partially spherical leading edge 203 and an obtuse relieved trailing edge 204.

As illustrated, insert 200 is oriented on the gage row of a roller cone such that leading edge 203 is oriented to contact the wellbore as a primary wear surface. Thus, in this embodiment, leading edge 203 is oriented to receive the compressive loads of the formation as the bit drills through formation. As illustrated, leading edge 203 is shaped to an aggressive geometry. During manufacture, the geometry of leading edge 203 may be designed to include a geometry specific to the formation being drilled. For example, in one embodiment, the specific geometry of leading edge 203 may be designed to distribute stress throughout cutting portion 202, thereby extending the life of insert 200. In other embodiments, leading edge 203 geometry may be designed to more effectively remove formation (e.g., aggressive geometry) and/or remove formation in a specified way (e.g., to produce a desired wellbore gage). Rather, leading edge 203 volume and geometry may be maintained according to known design processes for specific formation types. Due to the design process of embodiments disclosed herein the volume of leading edge 203 may be maintained, thereby preventing accelerated wear and carbide loss due to drilling. In fact, embodiments disclosed herein may allow leading edge 203 to remain substantially unaffected (i.e., maintaining carbide volume) by changes to the geometry of insert 200. Thus, in one embodiment, leading edge 203 may include an aggressive geometry to effectively remove formation by offsetting more carbide volume from trailing edge 204 to leading edge 203. Such an embodiment may thereby decrease wear to trailing edge 204 while allowing insert 200 to effectively remove formation.

In an exemplary embodiment, cutting structure 202 may be formed from tungsten carbide. Those of ordinary skill in the art will appreciate that compressive load encountered during drilling are favorable conditions for tungsten carbide. Tungsten carbide has a low rate of failure (e.g., fracturing and chipping) in inserts experiencing high compressive force loads. Because hard formations properties generally result in the application of high compressive loads on inserts, embodiments of the present disclosure including leading edges 203 formed from tungsten carbide may be desirable. However, those of ordinary skill in the art will appreciate that in alternate embodiments, leading edge 203 may be formed from mixtures of tungsten carbide, PDC, boron nitride, or other materials known in the art as suitable materials for drill bit inserts.

Trailing edge 204 is oriented opposite leading edge 203, such that trailing edge 204 does not form a primary cutting surface. Rather, trailing edge 204 is designed with an obtuse included angle to prevent trailing edge 204 from contacting the formation as a load bearing surface. While trailing edge 204 is not designed as a primary cutting surface, those of ordinary skill in the art will appreciate that some contact between trailing edge 204 and formation may occur. As such, trailing edge may include material properties capable of withstanding compressive forces, such as those discussed with regard to leading edge 203. Thus, trailing edge 204 may be formed from, for example, tungsten carbide, PDC, boron nitride, or other materials known in the art. The insert material is of less significance than the resultant geometry of trailing edge 204, as will be discussed below.

Figure 3:
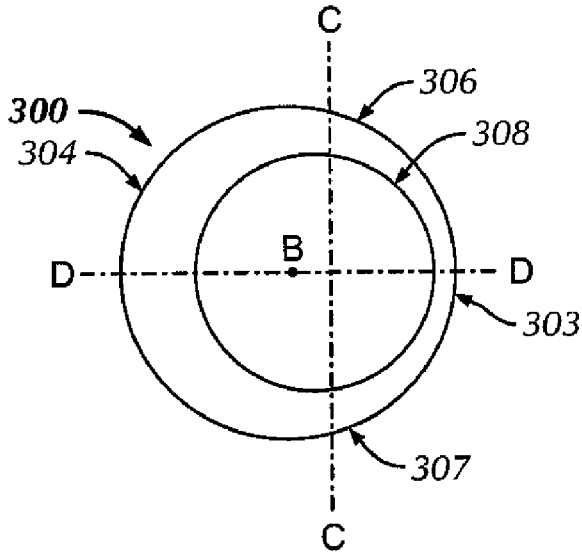
FIG. 3 shows a top view of an insert according to one embodiment of the present disclosure.

Referring to FIG. 3, a top view of an insert 300 according to one embodiment of the present disclosure is shown. Insert 300 includes a leading edge 303, a trailing edge 304, an inner side 306, and an outer side 307. Insert 300 is further defined by an insert axis B which runs through the geometric center of the insert. Leading edge 303 includes a partially spherical portion 308 that is generally conical in geometry. Partially spherical portion 308 is offset laterally forward of insert axis B, such that the volumetric center, illustrated at line C-C, of insert 300, is offset toward leading edge 303.

As illustrated, insert 300 contacts formation such that inner side 306 is located along the inside edge of a roller cone, while outer side 307 is located along the outer edge of the roller cone. In this embodiment inner side 306 and outer side 307 are illustrated as including substantially similar angular geometry with respect to partially spherical portion 308. Thus, leading edge 303 may include a generally conical cutting structure located volumetrically forward of insert axis B, and substantially symmetric forward of section C-C. Those of ordinary skill in the art will appreciate that conical cutting structures are known for providing effective leading edges in gage inserts used in hard formations because they are able to sheer formation while experiencing high compressive forces without propagating potentially dangerous stress points. Stress points in the cutting structure of an insert may result in chipping and/or breakage of the cutting structure, which may over time result in loss of a cutting element, row of cutting elements, or the entire drill bit.

Thus, maintaining leading edge 303 geometry to promote an effective sheering structure, while also providing an insert 300 capable of handling the high compressive forces of a gage row insert, may be promoted by maintaining a partially spherical portion 308. However, those of ordinary skill in the art will appreciate that other embodiments, wherein partially spherical portion 308 includes modified geometry with more aggressive cutting profiles, or wherein partially spherical portion 308 includes more planar profiles, are within the scope of the present disclosure.

Figure 4:
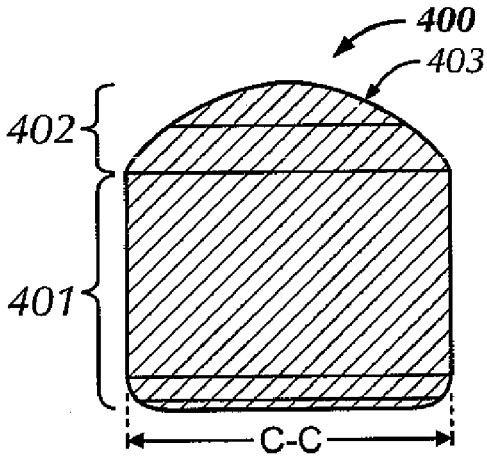
FIG. 4 shows a cross-section view of an insert according to one embodiment of the present disclosure.

Referring to FIG. 4, a cross-section view of insert 400 taken through section C-C of FIGS. 2 and 3 facing a leading edge 403 according to one embodiment of the present disclosure is shown. As illustrated, insert 400 includes a grip portion 401 and a cutting structure 402. As viewed through insert 400, cutting structure 402 includes a partially spherical portion (not independently labeled) defining leading edge 403. As illustrated, leading edge 403 is generally conical in geometry, as described above. By increasing leading edge 403 surface geometry, insert 400 may engage formation such that stresses on insert 400 are distributed over a larger area. Thus, maintaining or increasing the volume of cutting structure 402 toward leading edge 403 may decrease the wear to the cutting element, thereby extending the life of insert 400.

Figure 5:
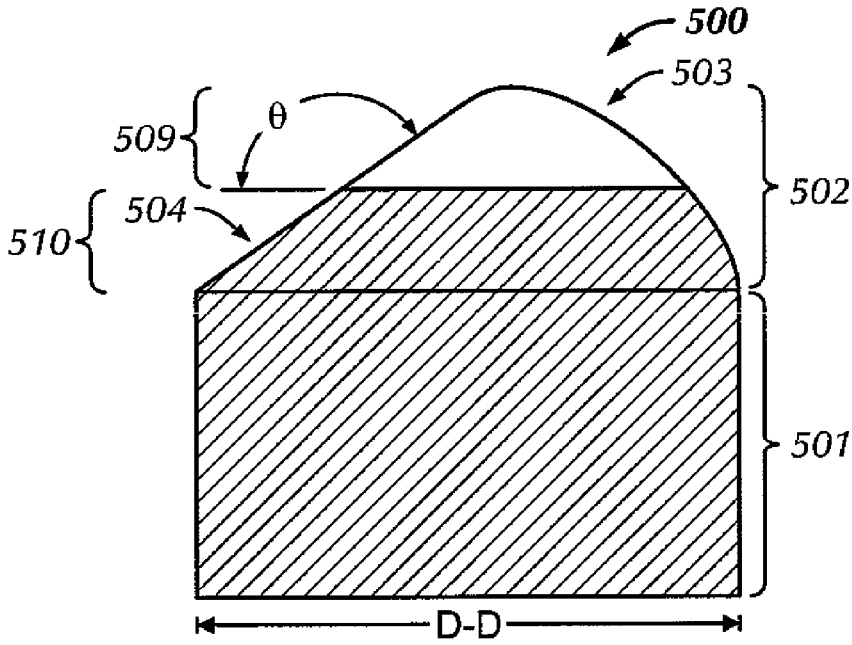
FIG. 5 shows a cross-section view of an insert according to one embodiment of the present disclosure.

Referring to FIG. 5, a cross-section view of insert 500 taken through section D-D of FIG. 3 according to one embodiment of the present disclosure is shown. Insert 500 includes a grip portion 501 and a cutting structure 502 including a leading edge 503 and a trailing edge 504. Additionally, insert 500 is illustrated after use, such that a portion of cutting structure 502 defines a wear portion 509, while a post wear extension portion 510 remains. An angle θ defines an included angle formed along trailing edge 504 as cutting structure 502 wears during use. Those of ordinary skill in the art will appreciate that initial included angle θ, prior to use, may be substantially 180°, or any other angle selected according to a specified geometry selected for a specific formation. Furthermore, included angle θ may vary according to the material used to form cutting structure 502, or according to the design preferences of a bit manufacturer without departing from the scope of the present disclosure. Examples of included angle θ wear patterns for post-run inserts are discussed below.

EXAMPLES

The following example represents trailing edge included angles after wear according to one embodiment of the present disclosure.

Figure 6:
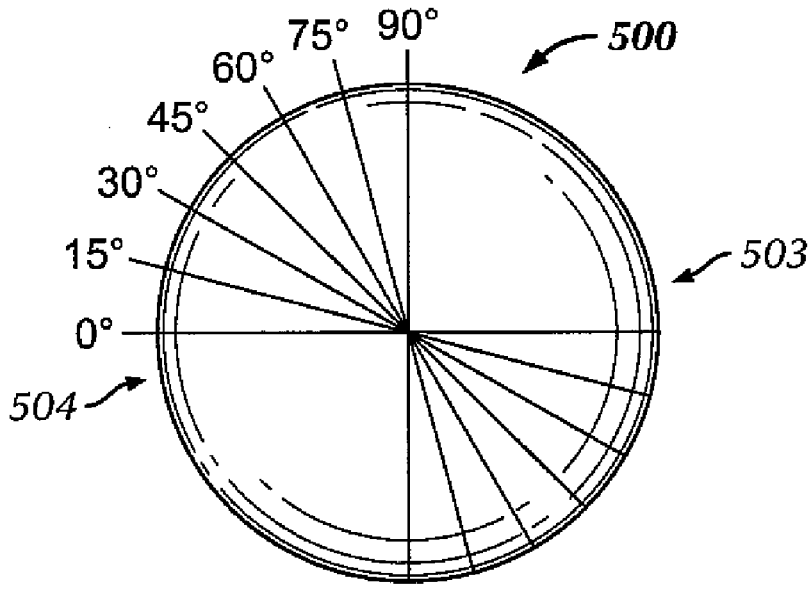
FIG. 6 shows a top view of centerline angles according to one embodiment of the present disclosure.

In an exemplary embodiment using insert 500, simulated post-run wear data defines a wear pattern difference between insert 500 of the present disclosure and a prior art semi-round top ("SRT") insert. As previously discussed, insert 500 includes a partially spherical leading edge 503 and an obtuse trailing edge 504. Initially, cutting structure 502 extends 0.140" above grip portion 501, and defines the portion of insert 500 that contacts formation. Because insert 500 includes a substantially symmetric conical leading edge 503, as discussed above relative to FIG. 3, the angles defining the centerline of insert 500 are substantially equal regardless of whether insert 500 is viewed from an inner side or an outer side. Referring briefly to FIG. 6, the angular orientation of centerlines taken at 0°, 15, 30°, 45°, 60°, 75°, and 90° are shown for insert 500, included a leading edge 503 and a trailing edge 504. Thus, one of ordinary skill in the art will appreciate that an angular measurement taken about one of the centerlines defined in FIG. 6 defines included angle θ for insert 500. Furthermore, because the entire cutting structure of prior art SRT inserts are symmetrically conical in geometry, the included angle for SRT inserts are assumed to be substantially equivalent taken from the trailing edge, or any edge approximating 270° to 90°. As such, only one included angle θ is defined for each post-wear extension measurement.

TABLE 1

| Trailing Side Included Angle (θ) Comparison After Wear | | | | | | | | |
|---|---|---|---|---|---|---|---|---|
| Post-Wear | Angle About Centerline | | | | | | | |
| Extension | 0° | 15° | 30° | 45° | 60° | 75° | 90° | SRT |
| 0.125" | 159.8° | 160.1° | 160.9° | 162.0° | 163.0° | 136.7° | 163.6° | 163.6° |
| 0.105" | 149.0° | 149.3° | 150.0° | 150.8° | 151.5° | 151.7° | 151.1° | 151.4° |
| 0.085 | 145.3° | 145.5° | 146.0° | 146.5° | 146.4° | 145.4° | 143.4° | 124.9° |
| 0.065" | 144.3° | 144.3° | 144.1° | 143.5° | 142.0° | 139.4° | 136.1° | 135.7° |
| 0.045" | 143.3° | 143.0° | 142.0° | 140.0° | 137.0° | 133.3° | 129.3° | 129.4° |
| 0.025" | 142.3° | 141.6° | 139.5° | 136.1° | 131.7° | 127.0° | 122.9° | 126.6° |
| 0.005" | 141.4° | 140.2° | 136.8° | 131.7° | 126.0° | 120.8° | 116.8° | 118.2° |

The above table illustrates post-wear extension 510 approximations for insert 500 according to embodiments of the present disclosure. Prior to discussing included angle θ approximations for insert 500, approximations of included angle θ for the SRT insert are discussed. As previously mentioned, included angle θ measurements for the SRT insert are approximated for any of angle trailing side centerline due to the geometric properties of the SRT insert. Initially, SRT insert included a cutting structure of 0.135" with an included angle θ approaching 180°. After 0.010" of wear, included angle θ was 163.6°, and continued to decrease until included angle θ was 118.2° with 0.005" of post-wear extension 510 remaining.

When compared to insert 500 of the present disclosure, the wear of included angle θ of the SRT insert was most closely comparable to the wear pattern of insert 500 taken about the 90° centerline. However, those of ordinary skill in the art will appreciate that the SRT insert will be more likely to experience chipping or breakage with an included angle θ of 118.2° than insert 500 with included angle θ of 116.8° taken at a 90° centerline, because of the increasingly obtuse wear pattern of insert 500 along the trailing side 504 of insert 500. Specifically, as included angles θ are compared progressing from measurements approximated at a 90° centerline to measurements approximated at a 0° centerline throughout post-wear extension 510 periods, the trend is for included angle θ to become increasingly obtuse the closer to trailing side 504 the measurement is taken.

Generally, during drilling, a greater obtuse included angle θ results in a decreased likelihood for chipping or breakage of trailing side 504. Thus, embodiments of the present disclosure may decrease chipping and breaking of trailing side 504 by maintaining a greater included angle θ. In an embodiment wherein insert 500 is formed from tungsten carbide, those of ordinary skill in the art will appreciate that maintaining trailing side 504 included angle θ as obtuse as possible may prevent chipping or breaking of insert 500. While the material properties of tungsten carbide make it an effective leading edge 503 material to handle the high compressive forces of drilling hard formation, tungsten carbide has a tendency to fail in tension. Because drilling causes compressive forces to be high on leading edge 503 and places trailing edge 504 in tension, tungsten carbide inserts of generally symmetric geometry (i.e., SRT inserts) have a tendency to chip along trailing edge 504. However, those of ordinary skill in the art will appreciate that by increasing included angle θ along trailing edge 504 of insert 500, as discussed above, the tension along trailing edge 504 may be decreased, thereby decreasing the likelihood of chipping of insert 500.

The above discussed embodiments may be especially beneficial in drilling hard formation, such as, for example, shale, sandstones, conglomerates, granite, calcites, mudstones, cherty limestone, and other hard and/or abrasive formation. Because the compressive loads on leading edge 503 and resultant tension on trailing edge 504 may be increased when drilling hard formation, increasing included angle θ along trailing edge 504 may decrease chipping and breaking of insert 500. Those of ordinary skill in the art will appreciate that additional formation types such as, for example, dolomite and other formation types where tension on a trailing edge of an insert causes breaking of the insert, may also benefit from the present disclosure.

Figure 7:
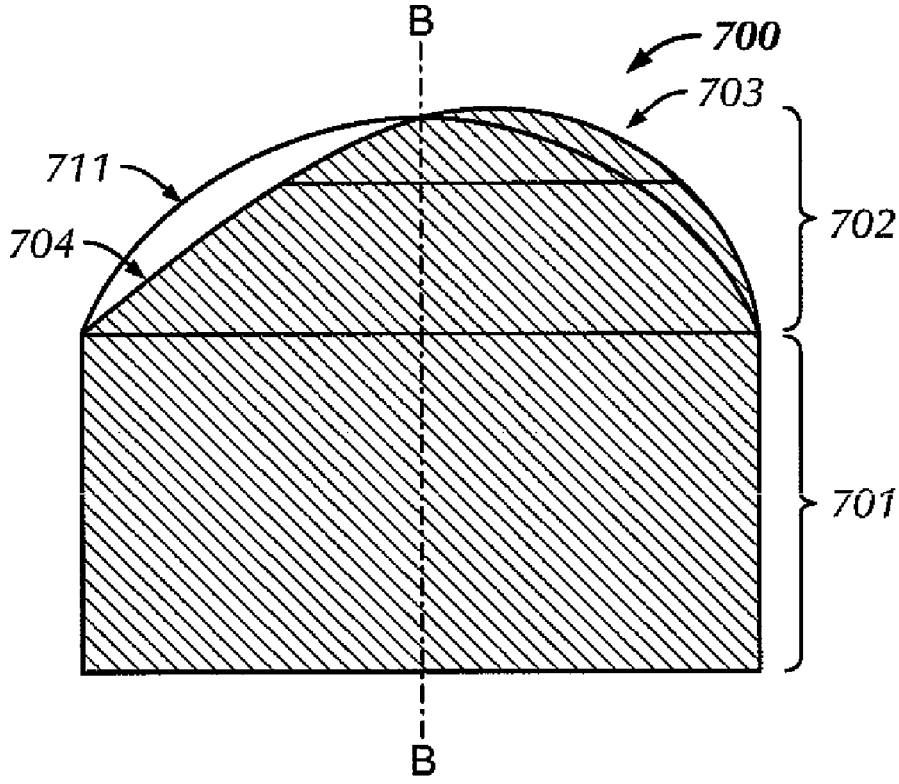
FIG. 7 shows a cross-section of an insert according to one embodiment of the present disclosure superimposed over a prior art insert.

Referring to FIG. 7, an insert 700 according to one embodiment of the present disclosure superimposed over a SRT insert 711 is shown. As illustrated, insert 700 includes a grip portion 701 and a cutting structure 702 including a leading edge 703 and a trailing edge 704. Insert 700 also has an axis B running through the geometric center of insert 700. In this embodiment, the volume of cutting structure 702 is offset, such that a greater volume of cutting structure 702 is located forward of axis B toward leading edge 703. Accordingly, trailing edge 704 includes less volume of cutting structure 702, resulting in a more blunt surface. Cutting structure 702 of insert 700 is also relatively taller than prior art insert 711, as illustrated by height different E. Despite the differences in geometric properties, the volume of cutting structure 702 is substantially similar to the volume of SRT insert 711.

In one embodiment, SRT insert 711 has a cutting structure 702 of 0.135" in height, with a grip portion 0.380" in height. The resultant volume of cutting structure 702 volume is 0.01154 $in^3$. In contrast, insert 700 has a cutting structure 702 of 0.140" in height, with a grip portion 0.380" in height. The resultant volume of cutting structure 702 of insert 700 is 0.01145 $in^3$. Thus, the difference in cutting structure 702 volume is 0.78%. Those of ordinary skill in the art will appreciate that a 0.78% difference in the volume of cutting structure 702 from SRT insert 711 makes the inserts volumetrically substantially similar.

Those of ordinary skill in the art will also appreciate that typically, inserts with a greater volume of cutting structure 702 may be able to drill longer. However, as described above, even inserts with greater cutting structure volume 702 fail drilling in hard formation due to trailing side 703 tension resulting in premature chipping and breaking of cutting structure 702. By decreasing cutting structure 702 volume along trailing side 703, thereby increasing the included angle during wear relative to prior art inserts 711, insert 700 is able to decrease tension along trailing side 703 during drilling.

It should be understood that while the present disclosure is described with reference to a drill bit having cutting elements which are inserts made from hard material, such as tungsten carbide and/or superhard material, such as diamond or cubic boron nitride, the shape of the exterior surface of selected cutting elements on a drill bit according to the disclosure is not limited to insert bits. Other roller cone bits known in the art, including those having cutting elements which are made from milled teeth having a hardfacing layer disposed thereon, are also within the scope of the present disclosure. Furthermore, trailing edge geometry may include convex, concave, planar, curved, parabolic, or any other geometry known in the art.

Advantageously, embodiments of the present disclosure include an obtuse relief trailing edge designed to maintain a substantially blunt surface during drilling. By increasing the included angle during drilling, embodiments of the present disclosure may exhibit less trailing edge fracturing, chipping, and/or breaking that often leads to loss of a gage insert, gage insert row, or the entire drill bit. By decrease insert failure, drill bits may thereby exhibit increased rate of penetration, reduction in wear, increased drill bit life, and more efficient overall drilling.

Moreover, by shifting the volume of the cutting structure to the leading edge of the insert, the life of the insert may be extended. Furthermore, shifting the volume allows an aggressive leading edge geometry to be maintained, thereby further increasing drilling efficiency while decreasing the likelihood of insert failure.

While the present disclosure has been described with respect to a limited number of embodiments, those skilled in the art, having benefit of this disclosure, will appreciate that other embodiments may be devised which do not depart form the scope of the disclosure as described herein. Accordingly, the scope of the disclosure should be limited only by the attached claims. Thus, while drilling a wellbore, an insert according to embodiments disclosed herein may retain a blunt trailing edge as gage wear occurs by relieving the trailing edge surface resulting in a substantially constant included angle. Such an included angle may decrease the chance for chipping, breaking, or failure of the insert, thereby extending the life of the gage row, and increasing the life of the bit when drilling hard formations.

Finally, because of the reduced tension along the trailing edge, those of ordinary skill in the art will appreciate that harder tungsten carbide grades made be used to form inserts. Such harder tungsten carbide may further slow the rate of insert wear during drilling, thereby further extending the life of the inserts. One of ordinary skill in the art, having reference to the present disclosure, will recognize that the various properties of inserts in accordance with the present disclosure may be modified, depending on the specific formation being drilled to further enhance wear characteristics of inserts.

While the disclosure has been described with respect to a limited number of embodiments, those skilled in the art, having benefit of this disclosure, will appreciate that other embodiments may be devised which do not depart form the scope of the disclosure as described herein. Accordingly, the scope of the present disclosure should be limited only by the attached claims.

What is claimed is:

1. A hard formation drill bit, comprising:

a bit body;

at least one roller cone attached to the bit body and able to rotate with respect to the bit body; and a plurality of gage cutting elements disposed on the at least one roller cone, at least one of the plurality of gage cutting elements comprising a grip portion and a cutting portion which cutting portion includes:

a leading edge comprising a partially spherical portion; and an obtuse relieved trailing edge;

wherein the partially spherical portion forms a major portion of the leading edge, wherein the leading edge has a substantially constant radius of curvature, said constant radius of curvature extending between proximate said grip portion to proximate said trailing edge, and wherein a volume of the partially spherical leading edge is greater than a volume of the obtuse relieved trailing edge.

2. The drill bit of claim 1, wherein at least one of the plurality of gage cutting elements is disposed on a gage row of the roller cone.

3. The drill bit of claim 1, wherein a geometry of the obtuse relieved trailing edge is substantially blunt.

4. The drill bit of claim 1, wherein the leading edge is offset from a geometric center of the cutting element.

5. The drill bit of claim 4, wherein the offset is forward of the geometric center of the cutting element.

6. The drill bit of claim 1, wherein at least one of the plurality of cutting elements comprises tungsten carbide.

7. The drill bit of claim 1, wherein the cutting portion comprises hardfacing.

8. The drill bit of claim 1, wherein from at least an extension height of 0.005 inches, the obtuse relieved trailing edge has included angles in the range of from 126.0 to 180.0 degrees, as measured within a region of the trailing edge between a centerline passing through a longitudinal axis of the cutting element taken at 0 degrees and a centerline passing through the longitudinal axis taken at 60 degrees.

9. The drill bit of claim 8, wherein within a region between a centerline passing through a longitudinal axis of the cutter element taken at 0 degrees and a centerline passing through the longitudinal axis taken at 30 degrees, the included angles range from 136.8 and 180.0 degrees.

10. The drill bit of claim 8, wherein within a region between a centerline passing through a longitudinal axis of the cutter element taken at 0 degrees and a centerline passing through the longitudinal axis taken at 15 degrees, the included angles range from 140.2 and 180.0 degrees.

11. The drill bit of claim 1, wherein the leading edge does not extend past the circumference of the grip portion of the at least one of the plurality of gage cutting elements.

12. A hard formation insert comprising:

a grip portion; and a gage cutting structure, the gage cutting structure comprising:

a leading edge comprising a partially spherical portion; and an obtuse relieved trailing edge;

wherein the partially spherical portion forms a major portion of the leading edge, wherein the leading edge has a substantially constant radius of curvature, said constant radius of curvature extending between proximate said grip portion to proximate said trailing edge, and wherein a volume of the partially spherical leading edge is greater than a volume of the obtuse relieved trailing edge.

13. The insert of claim 12, wherein the cutting structure comprises tungsten carbide.

14. The insert of claim 12, wherein the leading edge is offset of the geometric center of the insert.

15. The insert of claim 14, wherein the offset is forward of the geometric center of the insert.

16. A method of manufacturing a gage cutting element for hard formation drilling comprising:

designing the gage cutting element to comprise:

a cutting structure having a leading edge and an obtuse relieved trailing edge;

wherein the leading edge comprises a partially spherical portion which forms a major portion of the leading edge;

wherein the leading edge has a substantially constant radius of curvature, said constant radius of curvature extending between proximate said grip portion to proximate said trailing edge;

wherein a volume of the partially spherical leading edge is greater than a volume of the obtuse relieved trailing edge; and wherein the cutting structure is designed to wear during drilling to retain an obtuse included angle formed between the relieved trailing edge and a formation; and forming the gage cutting element.

17. The method of claim 16, wherein the gage cutting element comprises tungsten carbide.

18. The method of claim 16, wherein the leading edge is offset of the geometric center of the cutting element.

19. The method of claim 18, wherein the offset is forward of the geometric center of the cutting element.

20. A method of drilling a formation comprising:

contacting a drill bit with the formation, wherein the drill bit comprises a bit body; and a plurality of gage cutting elements disposed on the bit body, at least one of the plurality of gage cutting elements comprising a grip portion and a cutting portion which cutting portion includes:

a leading edge comprising a partially spherical portion; and an obtuse relieved trailing edge;

wherein the partially spherical portion forms a major portion of the leading edge;

wherein the leading edge has a substantially constant radius of curvature, said constant radius of curvature extending between proximate said grip portion to proximate said trailing edge; and wherein the volume of the partially spherical leading edge is greater than the obtuse relieved trailing edge.

21. The method of claim 20, wherein an included angle between the obtuse relieved trailing edge and the formation is greater than a second included angle between the partially spherical leading edge and the formation.

22. The method of claim 20, wherein the leading edge does not extend past the circumference of the grip portion of the at least one of the plurality of gage cutting elements.

23. The method of claim 20, wherein from at least an extension height of 0.005 inches, the obtuse relieved trailing edge has included angles in the range of from 126.0 to 180.0 degrees, as measured within a region of the trailing edge between a centerline passing through a longitudinal axis of the cutting element taken at 0 degrees and a centerline passing through the longitudinal axis taken at 60 degrees.

24. The method of claim 23, wherein within a region between a centerline passing through a longitudinal axis of the cutter element taken at 0 degrees and a centerline passing through the longitudinal axis taken at 30 degrees, the included angles range from 136.8 and 180.0 degrees.

25. The method of claim 23, wherein within a region between a centerline passing through a longitudinal axis of the cutter element taken at 0 degrees and a centerline passing through the longitudinal axis taken at 15 degrees, the included angles range from 140.2 and 180.0 degrees.

26. A hard formation drill bit, comprising:

a bit body;

at least one roller cone attached to the bit body and able to rotate with respect to the bit body; and at least one gage cutting element disposed on the at least one roller cone, the at least one gage cutting element comprising a cutting portion including:

a leading edge comprising a partially spherical portion, wherein the partially spherical portion forms a major portion of the leading edge; wherein the leading edge has a substantially constant radius of curvature, said constant radius of curvature extending between proximate said grip portion to proximate said trailing edge; and an obtuse relieved trailing edge;

wherein from at least an extension height of 0.005 inches, the obtuse relieved trailing edge has included angles in the range of from 126.0 to 180.0 degrees, as measured within a region of the trailing edge between a centerline passing through a longitudinal axis of the cutting element taken at 0 degrees and a centerline passing through the longitudinal axis taken at 60 degrees; and wherein a volume of the leading edge is greater than a volume of the obtuse relieved trailing edge.

27. The drill bit of claim 26, wherein within a region between a centerline passing through a longitudinal axis of the cutter element taken at 0 degrees and a centerline passing through the longitudinal axis taken at 30 degrees, the included angles range from 136.8 and 180.0 degrees.

28. The drill bit of claim 26, wherein within a region between a centerline passing through a longitudinal axis of the cutter element taken at 0 degrees and a centerline passing through the longitudinal axis taken at 15 degrees, the included angles range from 140.2 and 180.0 degrees.

* * * * *